US005680943A

United States Patent [19]

Robley

[11] Patent Number: 5,680,943

[45] Date of Patent: Oct. 28, 1997

[54] STANDING CLOSET DEVICE

[76] Inventor: David L. Robley, 3149 Hiraoka St., Lihue, Hi. 96766

[21] Appl. No.: 524,633

[22] Filed: Sep. 7, 1995

[51] Int. Cl.[6] ..... A47F 5/10; A47G 25/00

[52] U.S. Cl. ..... 211/171; 211/189; 211/195; 211/196; 211/205; 248/163.1

[58] Field of Search ..... 211/196, 205, 211/163, 165, 171, 172, 99 G, 100, 104, 195; 248/163.1, 432

[56] References Cited

U.S. PATENT DOCUMENTS

| | | | |
|---|---|---|---|
| 284,286 | 9/1883 | Downing | 211/171 |
| 338,923 | 3/1886 | Carr | 211/171 |
| 990,346 | 4/1911 | Dreyer | 211/163 |
| 1,069,643 | 8/1913 | Inden | 211/172 |
| 2,469,494 | 5/1949 | Bushko | 211/196 X |
| 3,941,250 | 3/1976 | Ott | 211/171 X |

FOREIGN PATENT DOCUMENTS

| | | | |
|---|---|---|---|
| 142371 | 9/1930 | Switzerland | 211/196 |

*Primary Examiner*—Leslie A. Braun
*Assistant Examiner*—Donald J. Wallace
*Attorney, Agent, or Firm*—Michael I. Kroll

[57] ABSTRACT

A standing closet device which comprises a stanchion. A structure placed upon a floor in a corner of a wall in a room of a building, is for supporting the stanchion in an upright position adjacent the corner of the wall. The supporting structure preferably includes a pair of elongated feet horizontally connected together at a right angle to form a corner, with a crossbar extending between facing sides of the feet. Alternatively, the elongated feet can be hinged to the stanchion so that they can swing up for storage into notched out vertical areas at a bottom end of the stanchion. A plurality of arms extend horizontally at a right angle at various heights from the stanchion, so that various articles, such as clothing and linen can be hung upon the arms.

6 Claims, 3 Drawing Sheets

STANDING CLOSET DEVICE

BACKGROUND OF THE INVENTION

1. Field of the Invention

The instant invention relates generally to storage racks and more specifically it relates to a standing closet device.

2. Description of the Prior Art

Numerous storage racks have been provided in prior art that are frameworks used for the safekeeping of various goods and articles held therein. While these units may be suitable for the particular purpose to which they address, they would not be as suitable for the purposes of the present invention as heretofore described.

SUMMARY OF THE INVENTION

A primary object of the present invention is to provide a standing closet device that will overcome the shortcomings of the prior art devices.

Another object is to provide a standing closet device with convenience and easy access to clothing and or linen with maximum space utilization to solve the problem of minimal dresser drawer space.

An additional object is to provide a standing closet device that is basically a self-supported corner stand with a plurality of non-slip hanging arms fixed at various heights forming a solid multi-functional structure to hang the clothing and or linen thereon.

A further object is to provide a standing closet device that is simple and easy to use.

A still further object is to provide a standing closet device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
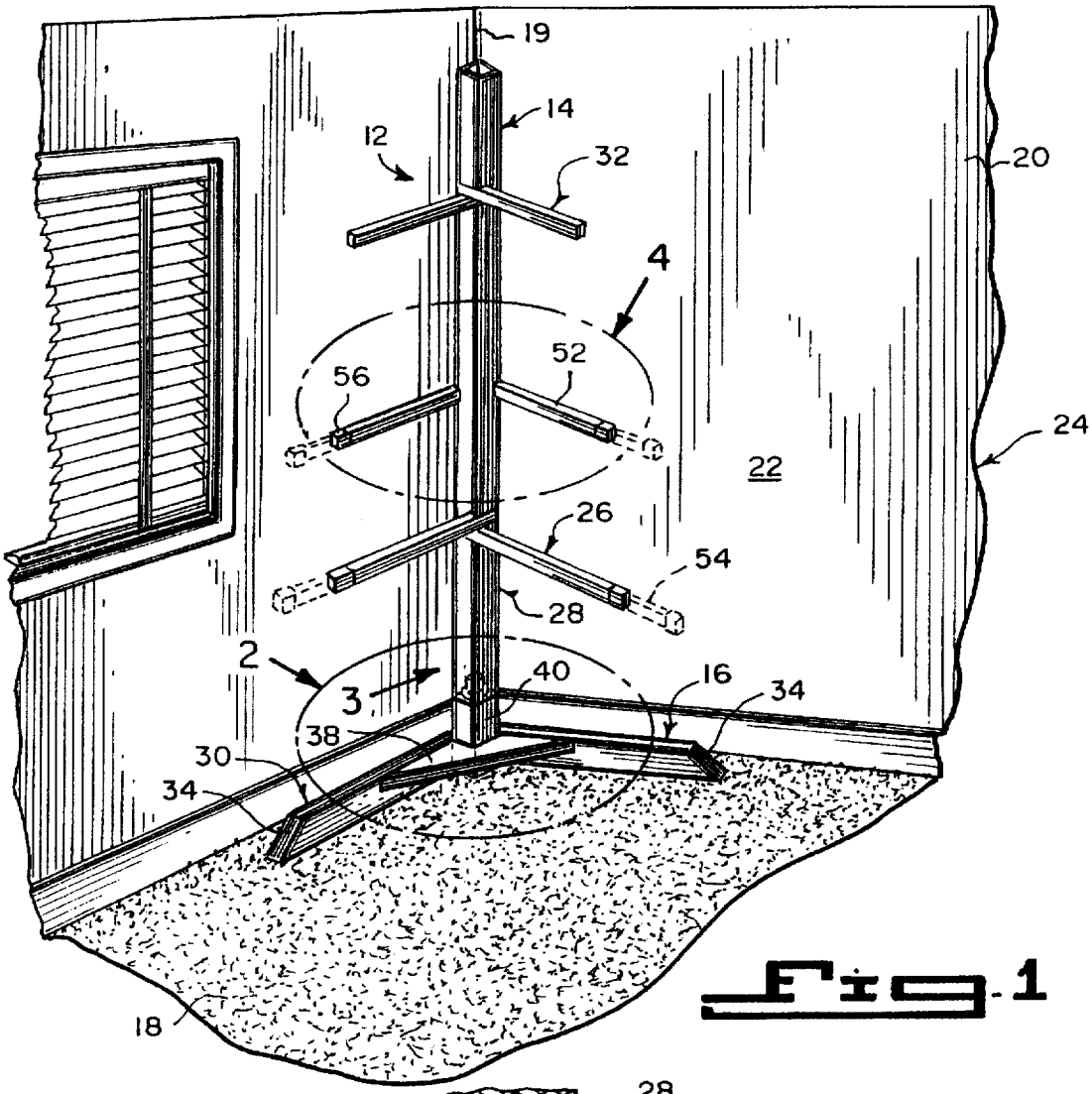
FIG. 1 is a perspective view of the instant invention in a corner of a room within a building.
Figure 2:
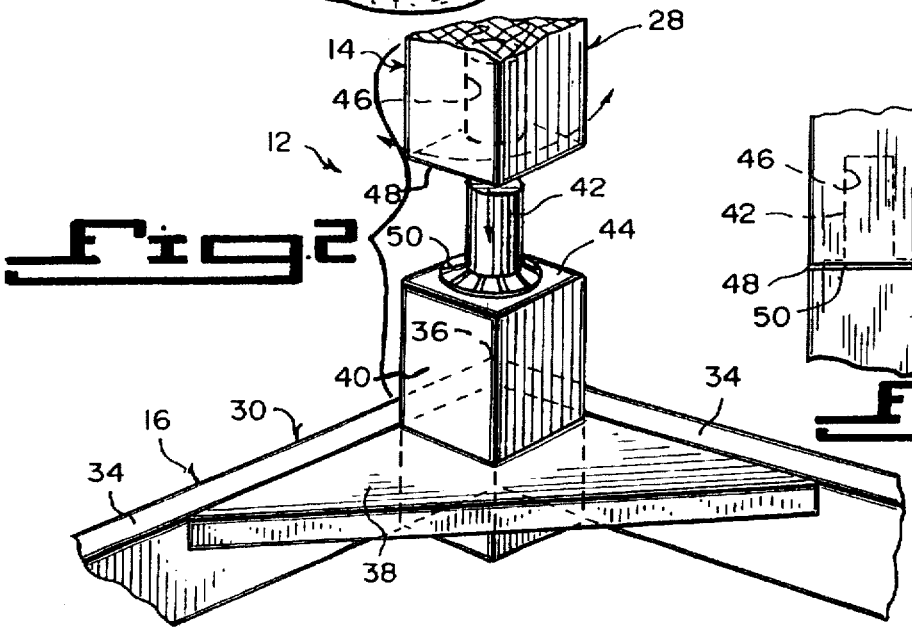
FIG. 2 is an enlarged front perspective view of the base as indicated by arrow 2 in FIG. 1, with the stanchion exploded therefrom.
Figure 3:
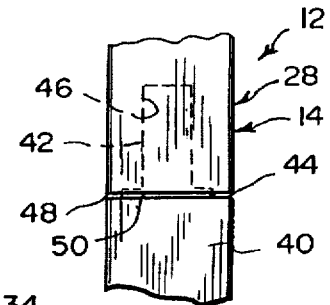
FIG. 3 is an elevational view of a portion thereof taken in the direction of arrow 3 in FIG. 1.
Figure 4:
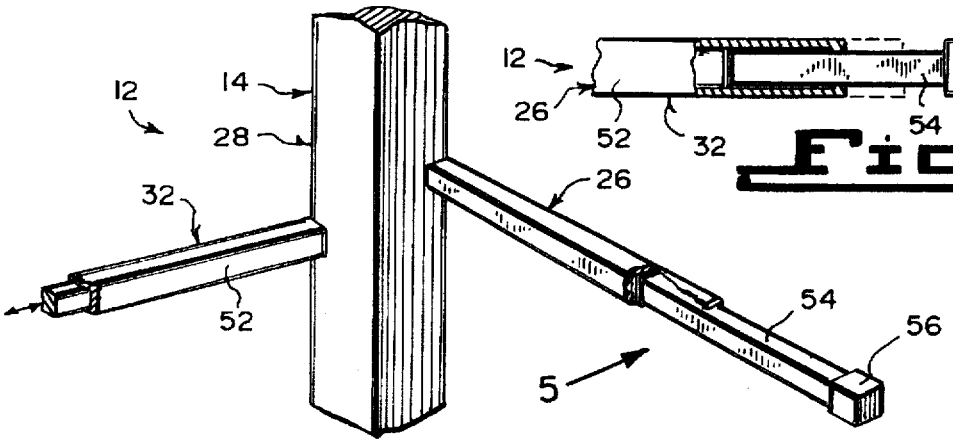
FIG. 4 is an enlarged perspective view of a portion of the stanchion as indicated by arrow 4 in FIG. 1, with parts of the adjustable arms broken away and in section.
Figure 5:
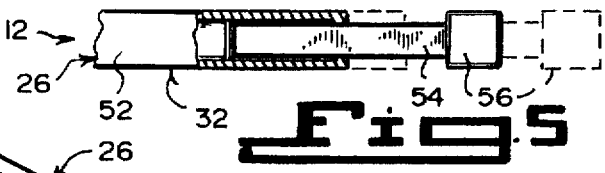
FIG. 5 is an elevational view taken in the direction of arrow 5 in FIG. 4, showing the adjustable arm in greater detail.

Turning now descriptively to the drawings, in which similar reference characters denote similar elements throughout the several views, FIGS. 1 through 5 illustrates a standing closet device 12, which comprises a stanchion 14. A structure 16 placed upon a floor 18 in a corner 19 of a wall 20 in a room 22 of a building 24, is for supporting the stanchion 14 in an upright position adjacent the corner 19 of the wall 20. A plurality of arms 26 extend horizontally at a right angle at various heights from the stanchion 14, so that various articles, such as clothing and linen can be hung upon the arms 26.

The stanchion 14 is an elongated post 28 being square shaped in cross section. The supporting structure 16 is a base member 30 having a right angle corner, so that the base member 30 can be placed upon the floor 18 at the corner 19 of the wall 20. Each arm 26 is an elongated rod 32 being square shaped in cross section.

The base member 30 includes a pair of elongated feet 34, horizontally connected together at a right angle to form a corner 36 therebetween. A crossbar 38 extends between facing sides of the elongated feet 34.

The base member 30 further contains a short leg 40 extending upwardly between the intersection of the pair of feet 34 and the crossbar 38. A pin 42 extends outwardly from a top end 44 of the short leg 40. The stanchion 14 has a socket 46 in a bottom end 48 to receive the pin 42, so that the stanchion 14 can rotate thereabout. A friction washer 50, best seen in FIG. 2, can fit onto the pin 42, so as to engage with the bottom end 48 of the stanchion 14 to prevent the stanchion 14 from rotating thereabout.

Some of the arms 26 are adjustable. Each adjustable arm 26 includes a hollow stationary portion 52, having a first end affixed to the stanchion 14 and an open second end. A telescopic portion 54 has a first end that is inserted into the open second end of the hollow stationary portion 52. An enlarged head 56 is on a second end of the telescopic portion 54.

Figure 6:
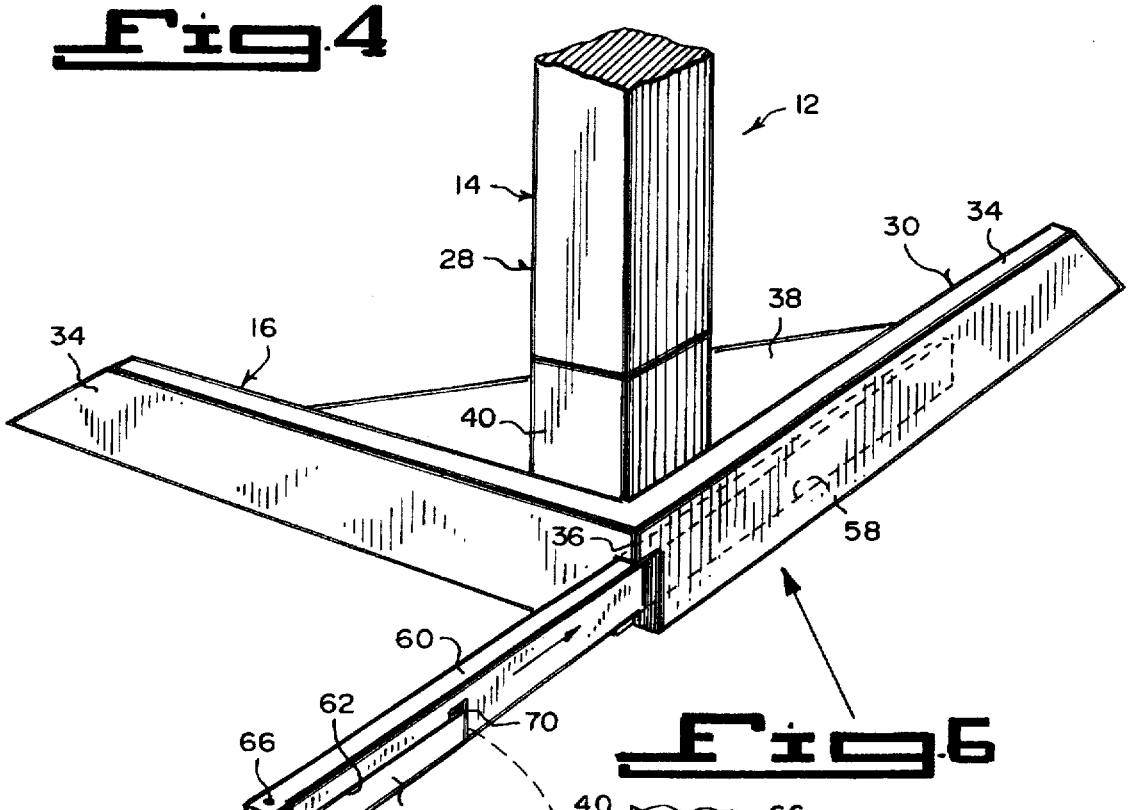
FIG. 6 is an enlarged rear perspective view of a second embodiment of the instant invention with a modified base being extendable.
Figure 7:
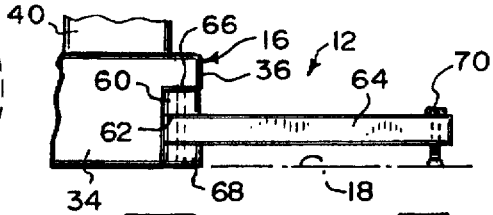
FIG. 7 is an end view taken in the direction of arrow 7 in FIG. 6.

As shown in FIGS. 6 and 7, the base member 30 can further contain one of the elongated feet 34 having a longitudinal slot 58 extending inwardly from the corner 36 thereof. A first support member 60 slides within the longitudinal slot 58, the first support member 60 has a bottom notched out area 62 at a free end. A second support member 64 is hinged at 66 to the free end of the first support member 60 at the bottom notched out area 62. The second support member 64 can swing out at a right angle to the first support member 60.

A stub foot 68 is on the hinged end 66 of the second support member 64, to make contact with the floor 18. An adjustable screw 70 transversely extends through a free end of the second support member 64, to make contact with the floor 18 to better support the stanchion 14 in the upright position away from the corner 19 of the wall 20.

A modified standing closet device 72 is shown in FIGS. 8 through 11. The stanchion 74 has a pair of notched out vertical areas 76 at a bottom end 78 that are at a right angle to each other. A pair of elongated feet 80 are provided. Each foot 80 is hinged at 82 to the stanchion 74 in one notched out vertical areas 76. The feet 80 can swing up for storage and swing down for use.

A pair of braces 84 are also provided. Each brace 84 is hinged at one end to one side of one foot 80. When each foot 80 swings down for use, each brace 84 will swing up at an angle with its free end engaging with the stanchion 74, to keep the foot 80 down horizontally.

The stanchion 74 has a plurality of vertical recessed areas 86 for the arms 88. Each arm 88 is hinged at one end 90 to a lower end of each vertical recessed area 86. Each arm 88 can swing up for storage and swing down for use.

Figure 8:
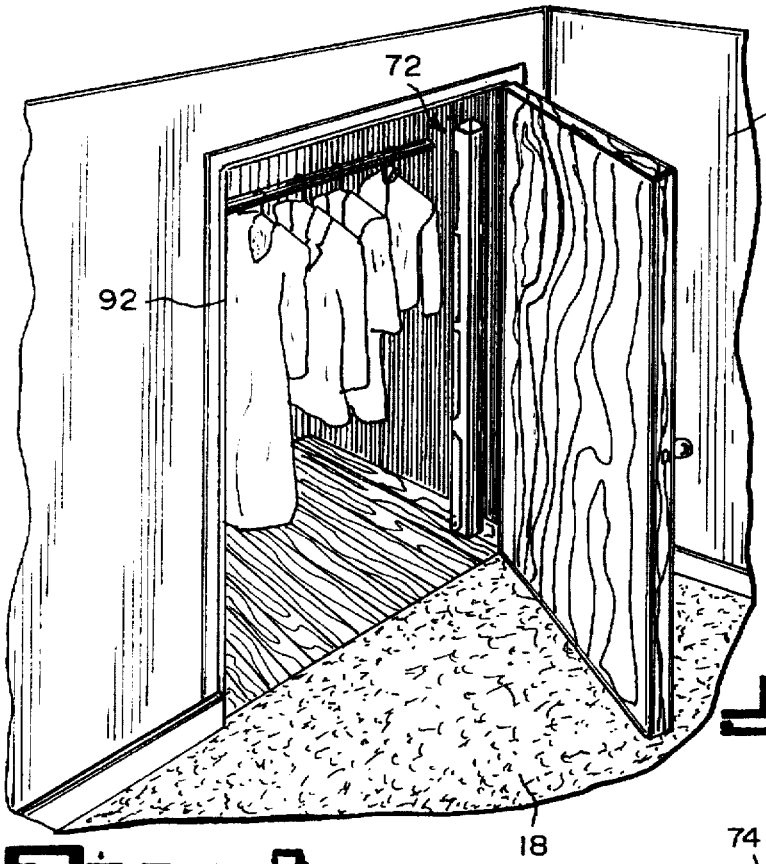
FIG. 8 is a rear perspective view of a third embodiment of the instant invention shown in a collapsed position and stored within a closet of a room within a building.
Figure 10:
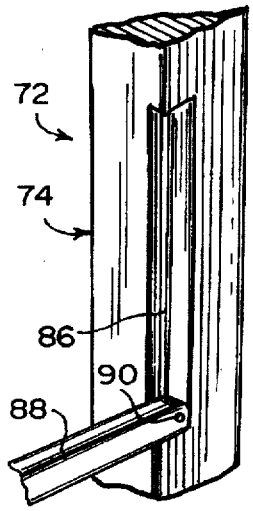
FIG. 10 is a further enlarged side perspective view of a portion of the stanchion and one fold down arm as indicated by arrow 10 in FIG. 9.
Figure 9:
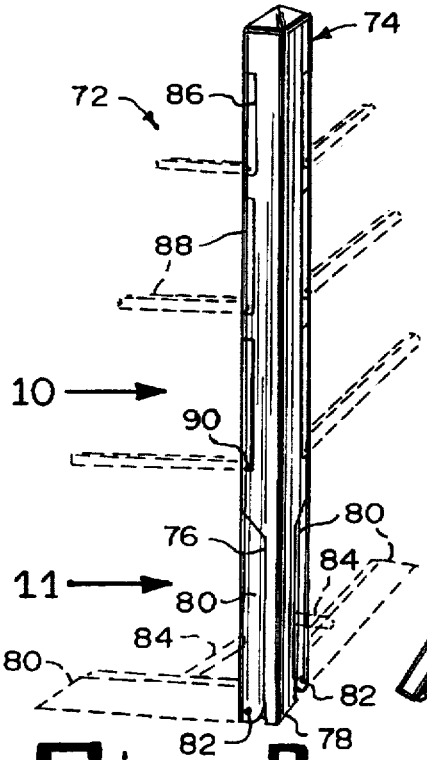
FIG. 9 is an enlarged rear perspective view of the third embodiment in the collapsed position and showing an operable position thereof in dotted lines.
Figure 11:
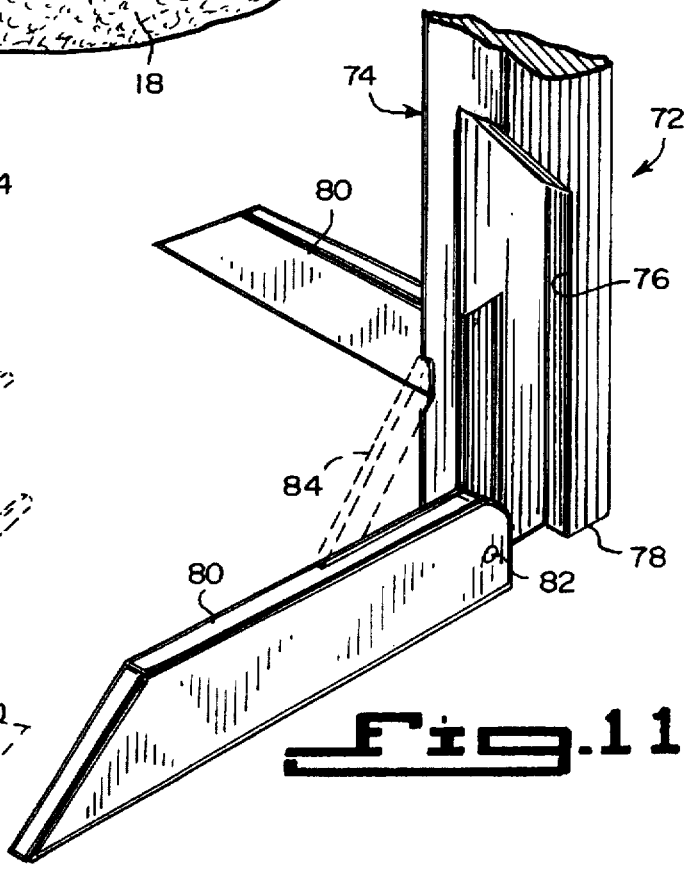
FIG. 11 is a further enlarged side perspective view of a portion of the stanchion and the fold down base, as indicated by arrow 11 in FIG. 9.

As shown in FIG. 8, the modified standing closet device 72 can be placed to one side within a closet 92. The arms 88 and feet 80 are in the up storage position on the stanchion 74. The modified standing closet device 72 can then be removed from the closet 92, and placed on the floor 18 at the corner 19 of the wall 20 with the arms 88 and feet 80 down ready to be used.

LIST OF REFERENCE NUMBERS

12 standing closet device
14 stanchion of 12
16 supporting structure of 12
18 floor
19 corner of 20
20 wall in 22
22 room of 24
24 building
26 arm of 12
28 elongated post for 14
30 base member for 16
32 elongated rod for 26
34 elongated foot of 30
36 corner of 34
38 crossbar of 30
40 short leg of 30
42 pin of 30
44 top end of 40
46 socket in 48
48 bottom end of 14
50 friction washer on 42
52 hollow stationary portion of 26
54 telescopic portion of 26
56 enlarged head on 54
58 longitudinal slot in 34
60 first support member
62 bottom notched out area of 60
64 second support member
66 hinged end of 64
68 stub foot on 66
70 adjustable screw on 64
72 modified standing closet device
74 stanchion of 72
76 notched out vertical area in 74
78 bottom end of 74
80 elongated foot of 72
82 hinge on 80
84 brace of 72
86 vertical recessed area in 74
88 arm of 72
90 hinge on 88

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A standing closet device which comprises:

a) a stanchion;

b) means placeable upon a floor in a corner of a wall in a room of a building, for supporting said stanchion in an upright position adjacent the corner of the wall, said supporting means being a base member having:

i) a pair of elongated feet horizontally connected together at a right angle to form a corner therebetween so that said base member can be placed upon the floor at the corner of the wall, ii) a crossbar extending between facing sides of said elongated feet;

iii) a longitudinal slot extending inwardly from the corner of one of said elongated feet;

iv) a first support member that slides within said longitudinal slot, said first support member having a bottom notched out area at a free end;

v) a second support member hinged at an end to the free end of said first support member at the bottom notched out area, whereby said second support member can swing out at a right angle to said first support member;

vi) a stub foot on the hinged end of said second support member to make contact with the floor; and vii) an adjustable screw transversely extending through a free end of said second support member, to make contact with the floor to better support said stanchion in the upright position away from the corner of the wall; and c) a plurality of arms extending horizontally at a right angle at various heights from said stanchion, so that various articles can be hung upon said arms.

2. A standing closet device as recited in claim 1, wherein:

a) said stanchion is an elongated post being square shaped in cross section;

b) each said arm is an elongated rod being square shaped in cross section; and c) said base member further includes:

i) a short leg extending upwardly between the intersection of said pair of feet and said crossbar;

ii) a pin extending outwardly from a top end of said short leg; and iii) said stanchion having a socket in a bottom end to receive said pin, so that said stanchion can rotate thereabout.

3. A standing closet device which comprises:

a) a stanchion having a pair of notched out vertical areas at a bottom end that are at a right angle to each other;

b) means placeable upon a floor in a corner of a wall in a room of a building, for supporting said stanchion in an upright position adjacent the corner of the wall, said means including a pair of elongated feet, in which each said foot is hinged to said stanchion in one said notched out vertical area, so that said feet can swing up for storage and swing down for use;

c) a pair of braces, each said brace hinged at one end to one side of one said foot, so that when each said foot swings down for use each said brace will swing up at an angle with a free end engaging with said stanchion, to keep said foot down horizontally; and d) a plurality of arms extending horizontally at a right angle at various heights from said stanchion, so that various articles can be hung upon said arms, each said arm being an elongated rod which is square shaped in cross section.

4. A standing closet device as recited in claim 3, further including:

a) said stanchion having a plurality of vertical recessed areas for said arms; and b) each said arm is hinged at one end to a lower end of each said vertical recessed area, so that each said arm can swing up for storage and swing down for use.

5. A standing closet device as recited in claim 3, wherein said stanchion is an elongated post being square shaped in cross section.

6. A standing closet device as recited in claim 5, further including:

a) said stanchion having a plurality of vertical recessed areas for said arms; and b) each said arm is hinged at one end to a lower end of each said vertical recessed area, so that each said arm can swing up for storage and swing down for use.

* * * * *